US005205708A

United States Patent [19]

Plemmons et al.

[11] Patent Number: 5,205,708

[45] Date of Patent: Apr. 27, 1993

[54] HIGH PRESSURE TURBINE COMPONENT INTERFERENCE FIT UP

[75] Inventors: Larry W. Plemmons, Fairfield; Robert Proctor, W. Chester, both of Ohio; Robert J. Albers, Park Hills, Ky.

[73] Assignee: General Electric Company, Cincinnati, Ohio

[21] Appl. No.: 832,823

[22] Filed: Feb. 7, 1992

[51] Int. Cl.[5] ..... F01D 25/24; F01D 11/00; B21D 53/92

[52] U.S. Cl. ..... 415/173.1; 415/116; 415/214.1; 29/889.2; 29/446; 29/525

[58] Field of Search ..... 415/115, 116, 173.1, 415/173.5, 208.3, 208.5, 209.2, 214.1; 29/889.2, 446, 450, 452, 525

[56] References Cited

U.S. PATENT DOCUMENTS

| | | | |
|---|---|---|---|
| 3,056,583 | 10/1962 | Varadi et al. | 253/78 |
| 3,575,523 | 4/1971 | Gross, Jr. | 415/173.1 |
| 3,860,358 | 1/1975 | Cavicchi et al. | 415/174 |
| 4,005,946 | 2/1977 | Brown et al. | 415/178 |
| 4,303,371 | 12/1981 | Eckert . | |
| 4,529,355 | 7/1985 | Wilkinson | 415/174 |
| 4,573,865 | 3/1986 | Hsia et al. . | |
| 4,642,024 | 2/1987 | Weidner | 415/116 |
| 5,022,816 | 6/1992 | Maier et al. | 415/182.1 |
| 5,127,793 | 7/1992 | Walker et al. | 415/173.1 |

*Primary Examiner*—Edward K. Look
*Assistant Examiner*—Michael S. Lee
*Attorney, Agent, or Firm*—Jerome C. Squillaro; John R. Rafter

[57] ABSTRACT

An interference fit up for an HPT hanger is accomplished by machining and casting features into the hanger which create a spring effect when the hanger is assembled into the support. The spring effect may be accomplished in a variety of ways, including offset radial cut features on the hanger relative to the support, or offset projection features on the hanger which are concentric with the support. The spring effect is then accomplished by a flex or deflection of the ends of the hanger to conform to the width of the support, and clearance indentations created during the installation.

20 Claims, 4 Drawing Sheets

HIGH PRESSURE TURBINE COMPONENT INTERFERENCE FIT UP

BACKGROUND OF THE INVENTION

The present invention relates to interference fit ups and, more particularly, to a method for achieving interference fit ups, such as for high pressure turbine hangers for a gas turbine engine. The application is related to co-pending commonly assigned application, Ser. No. 07/702,549, filed May 20, 1991, the disclosure of which is incorporated by reference herein.

Interference fit ups of high pressure turbine (HPT) components is a method of locating and holding parts in the engine. Typically, this type of fit up is accomplished for segmented parts by a procedure known as dimpling. In this procedure, a dimple is put into a part by deforming a flat section by pulling the material, which can be accomplished by any suitable means, such as hydraulically. In this pulled region, the material is plastically deformed into a mound shape, resulting in the term dimple. Necessary loads for achieving this type of deformation are dependent upon material thickness. For example, for material which is in the region of 0.1 inches, a typical load is in the 5000 lbf range.

This dimpling procedure is used for fit ups on segmented high pressure turbine shroud hangers to locate and restrain them in the 360° support structure of the hanger. Dimples are located on both the forward and aft rails of the hanger and are toleranced to achieve an interference fit with the support structure. The hanger is then essentially forced to lodge in the support with typical interference ranges being from line to line to 0.004 inches maximum.

Unfortunately, the force used to lodge the hanger in the support deforms the material of the hanger, compromising component mechanical integrity. Sensitivities arise in the material as a result of the reduction and destruction of the material properties and capabilities, affecting the form, fit, and function of the component. Additionally, the elastic properties of the material are destroyed by the plastic deformation. Finally, when the rails are removed during maintenance, it is difficult to reproduce the interference requirements for continued engine operation, requiring the expense of either reworking or replacing parts.

It is seen then that there exists a need for an interference fit up of components which does not compromise component mechanical integrity and the form, fit, and function of the component, particularly a fit up which would reduce part cost.

SUMMARY OF THE INVENTION

This need is met by the HPT component interference fit up according to the present invention, wherein the interference fit is accomplished by machining and casting features into the hanger, which creates a spring type effect when the hanger is assembled into the support.

In accordance with one aspect of the present invention, a method and apparatus for accomplishing an interference fit comprises the steps of providing a support member having a first radius and a first width and providing a hanger having a second radius and a second width. The hanger also includes a first end and a second end. The second radius of the hanger is then offset relative to the first radius of the support, such that the second radius is greater than the first radius. The method further includes the step of driving the hanger into the support. Finally, the method includes the step of creating a spring in the hanger by flexing the first end and the second end of the hanger to conform to the first width of the support.

In accordance with another embodiment of the invention, a method for accomplishing an interference fit comprises the steps of providing a support member having a first radius and a first width and providing a hanger having a first end section with a first projection, a second end section with a second projection, and a middle section with a third projection. The first end section and the second end section have a second width at the first and second projections, and the middle section has a second radius and a third width at the third projection. The method also includes the step of offsetting the first and second projections with the third projection, such that the first and second projections extend outward from one side of the hanger and the third projection extends outward in an opposite direction from an opposing side of the hanger. The method further includes the step of driving the hanger into the support. Finally, the method includes the step of creating a spring in the hanger by flexing the first end section and the second end section of the hanger to conform to the first width of the support and providing a clearance indentation on either side of the third projection.

It is an advantage of the present invention that a manufacturing operation is eliminated, thereby saving money. It is an object of the present invention to eliminate the dimpling procedure, thereby eliminating both the time it would normally take to perform the dimpling operation and the dimpling tool, as well as the inspection time previously required to inspect the dimpling operation. It is a further object of the present invention to use a spring effect to achieve the interference fit, to avoid physically destroying properties of the material and eliminate local plastic deformation. It is an advantage of the present invention that it allows control of component fit up stresses, component deflection, and interference itself. The increased frictional/contact area allows for a better interference fit to be obtained. Other objects and advantages of the invention will be apparent from the following description, the accompanying drawings and the appended claims.

The invention accordingly comprises the features of construction, combination of elements and arrangement of parts, all as set forth below, and the scope of the invention will be indicated in the claims.

For a full understanding of the nature and objects of the present invention, reference may be had to the following detailed description taken in conjunction with the accompanying drawings and the appended claims.

BRIEF DESCRIPTION OF THE DRAWINGS

Corresponding reference numerals refer to like parts throughout the several views of the drawings.

DETAILED DESCRIPTION OF THE PREFERRED EMBODIMENTS

The present invention provides a unique method for achieving interference fit ups for the HPT hanger by machining and casting features into the hanger which create a spring type effect when the hanger is assembled into the support. The spring and associated stresses in the component are within the elastic limits of the material. This allows efficient control of component fit up stresses and component deflection, resulting in an increased frictional/contact area which provides an improved interference fit.

Figure 1:
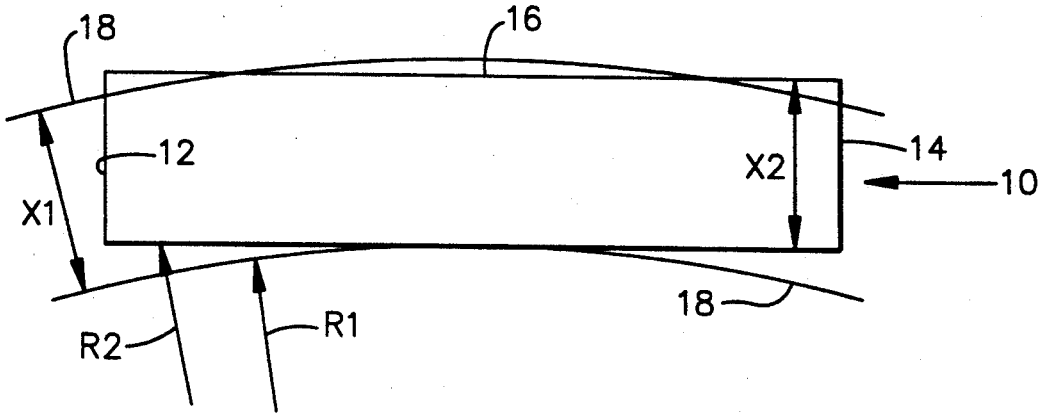
FIG. 1 is a pre-installation view of a hanger being inserted into a support, in accordance with one embodiment of the present invention.

Referring now to the drawings, in FIG. 1 there is illustrated a pre-installation view of a hanger 10, having a first end 12, a second end 14, and a middle section 16, superimposed on a support member 18, in accordance with one embodiment of the present invention. The support member 18 has a first radius R1 and a first width X1. The hanger 10 has a second radius R2 and a second width X2. The second radius R2 is offset relative to the first radius R1, such that the second radius R2 is greater than the first radius R1. In addition, the first width X1 is preferably larger than the second width X2.

As can be seen in FIG. 1, since the second radius R2 of the hanger 10 is larger than the first radius R1 of the support member 18, the support member 18 is more curved than the hanger 10. Hence, a portion of each of the ends 12 and 14 of the hanger 10 extends radially outwardly beyond the width X1 of the support member 18. During installation, the hanger 10 is driven into the support member 18, creating a spring effect in the hanger 10. The spring effect in FIG. 1 is created by the flex, or deflection, in the ends 12 and 14 of the hanger 10 to conform the ends 12 and 14 to the first width X1 of the support member 18.

Figure 2:
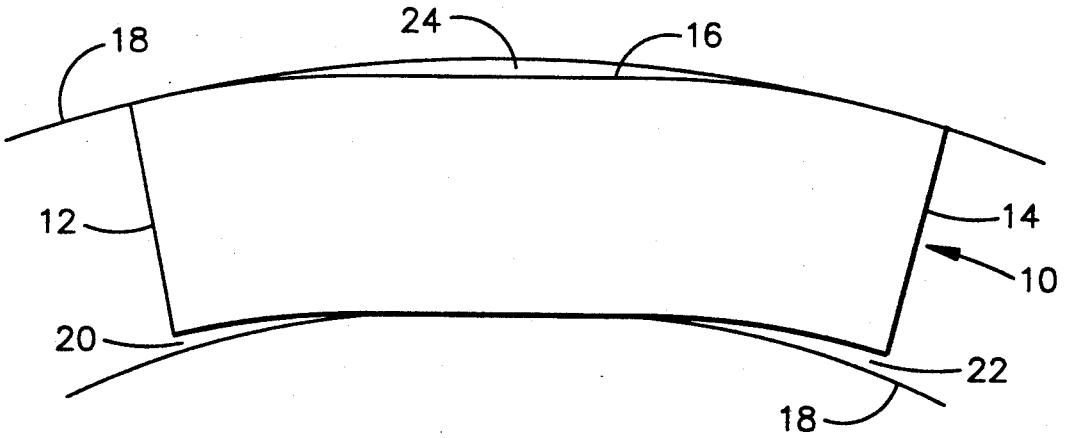
FIG. 2 is a post-installation view of a hanger being inserted into a support, in accordance with the embodiment illustrated in FIG. 1.

The combined effect of driving the hanger 10, having the greater radius R2 yet the smaller width X2, into the support member 18, having the smaller radius R1 yet the greater width X1, causes clearance spaces between the hanger 10 and the support member 18 after installation. These clearance spaces permit the spring effect in the hanger 10 to be created by the flexing of the ends 12 and 14. The post- installation view shown in FIG. 2 illustrates first and second clearance indentations 20 and 22 between the ends 12 and 14 and the support member 18 at the inside radius area, and a third clearance indentation 24 between the support member 18 and the middle section 16 at the outside radius area. Since the hanger 10 is preferably made of a material having elastic limits, and the spring effect is within the elastic limits of the hanger 10 material, the mechanical integrity and the form, fit, and function of the hanger 10 is not compromised. It will be obvious to those skilled in the art that the radii of the hanger 10 and the support member 18 may be varied to achieve the desired offset effect for an interference fit.

Figure 3:
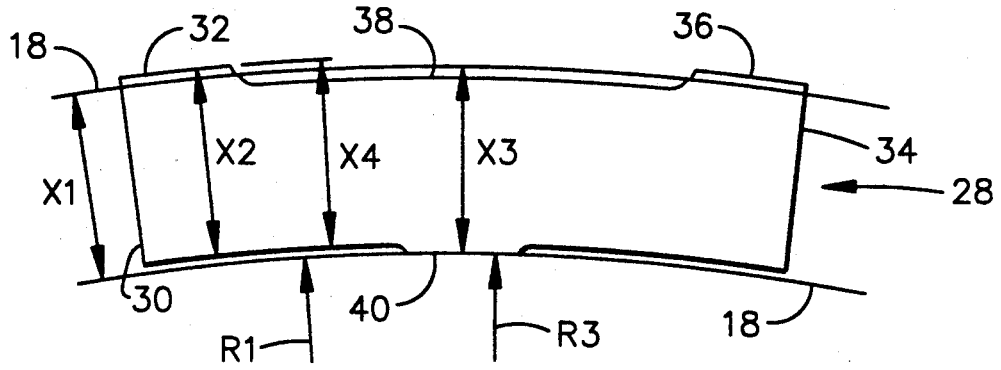
FIG. 3 is a pre-installation view of a hanger being inserted into a support, in accordance with a second embodiment of the present invention.
Figure 4:
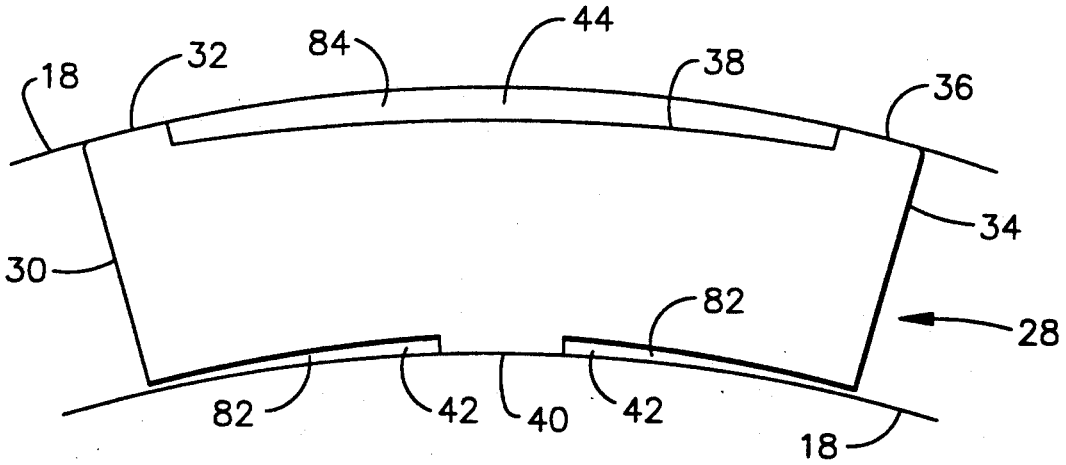
FIG. 4 is a post-installation view of a hanger being inserted into a support, in accordance with the embodiment illustrated in FIG. 3.

Referring now to FIG. 3, there is illustrated a pre-installation view of a hanger 28 superimposed on the support member 18, in accordance with a second embodiment of the present invention. The hanger 28 has a first end section 30 having a first projection 32, a second end section 34 having a second projection 36, and a middle section 38 having a third projection 40. The support member 18 has the first radius R1 and the first width X1 and the hanger 28 has a second radius R3, measured through the middle section 38 of the hanger 28, and including the third projection 40. The hanger 28 further includes a second width X2 at each end section 30 and 34, which includes the projections 32 and 36, respectively, and a third width X3 through the middle section 38, including the third projection 40. The projections 32, 36, and 40 are offset such that the first and second projections extend radially outwardly from the ends 30 and 34, and the third projection extends radially inwardly from the middle section 38 of an opposing side of the hanger 28. Although FIGS. 3 and 4 illustrate three projections, it will be obvious to those skilled in the art that the number of projections may be varied to achieve the desired offset effect for an interference fit. Preferably, in this embodiment, the offset projections on the hanger 28 are concentric with the support member 18 features.

In FIGS. 3 and 4, the width X1 is preferably greater than the width X2, and also preferably greater than the width X3. However, the first width X1 is equivalent to or less than a total width X4, measured to include all three projections 32, 36, and 40. Furthermore, it is preferred in this embodiment that the radius R1 be equal to the radius R3, making the offset projections 32, 36, and 40 concentric with the support member 18. Having concentric offset projections results in the ends 30 and 34 of the hanger 28 extending radially outwardly from the width X1 of the support member 18 prior to the installation of the hanger 28.

Figure 5:
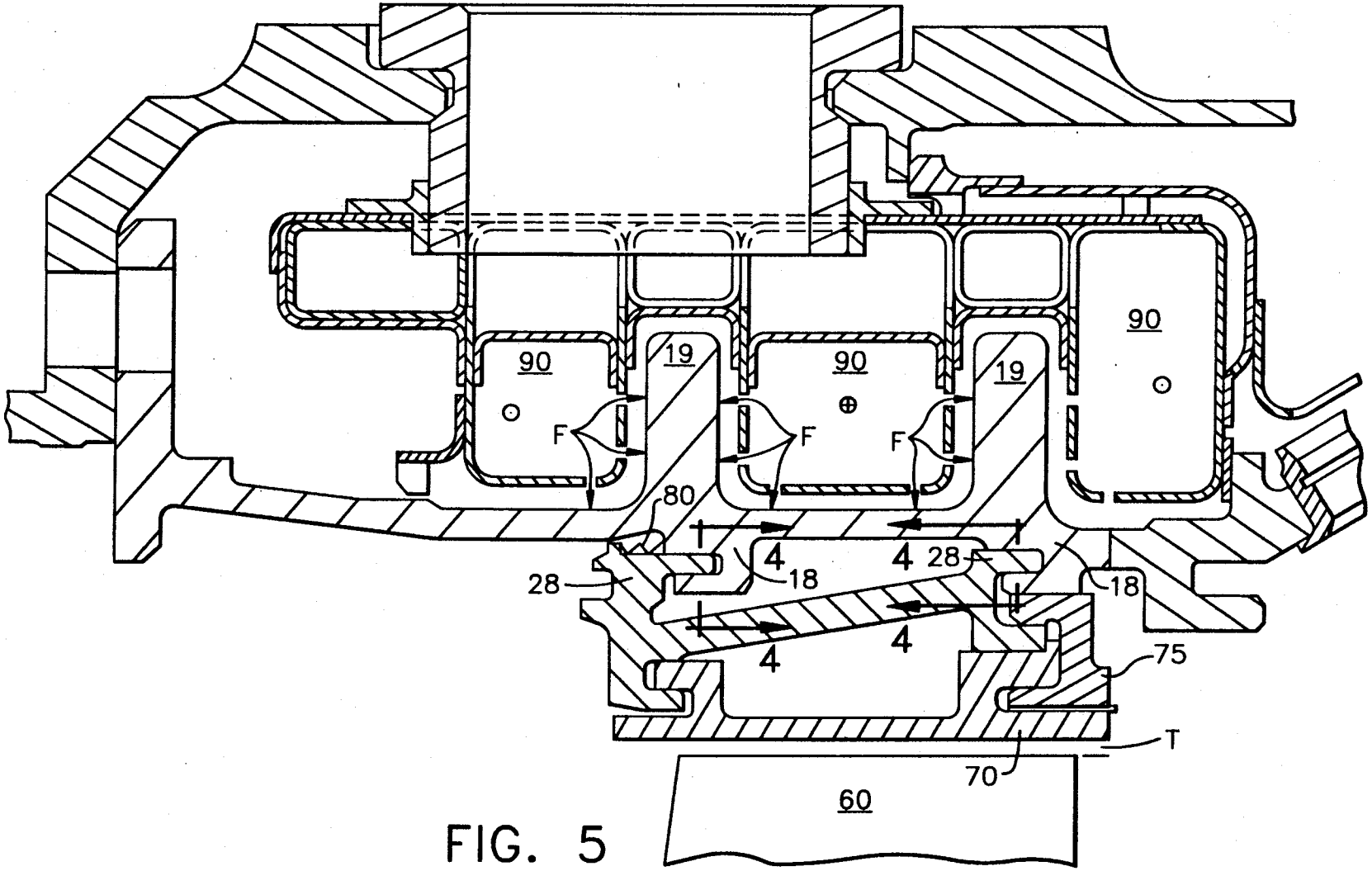
FIG. 5 is an cross sectional illustration of a support case, hnagar and shroud assembly spaced from a rotating engine structure and cooled by a inpingement manifold assembly
Figure 6:
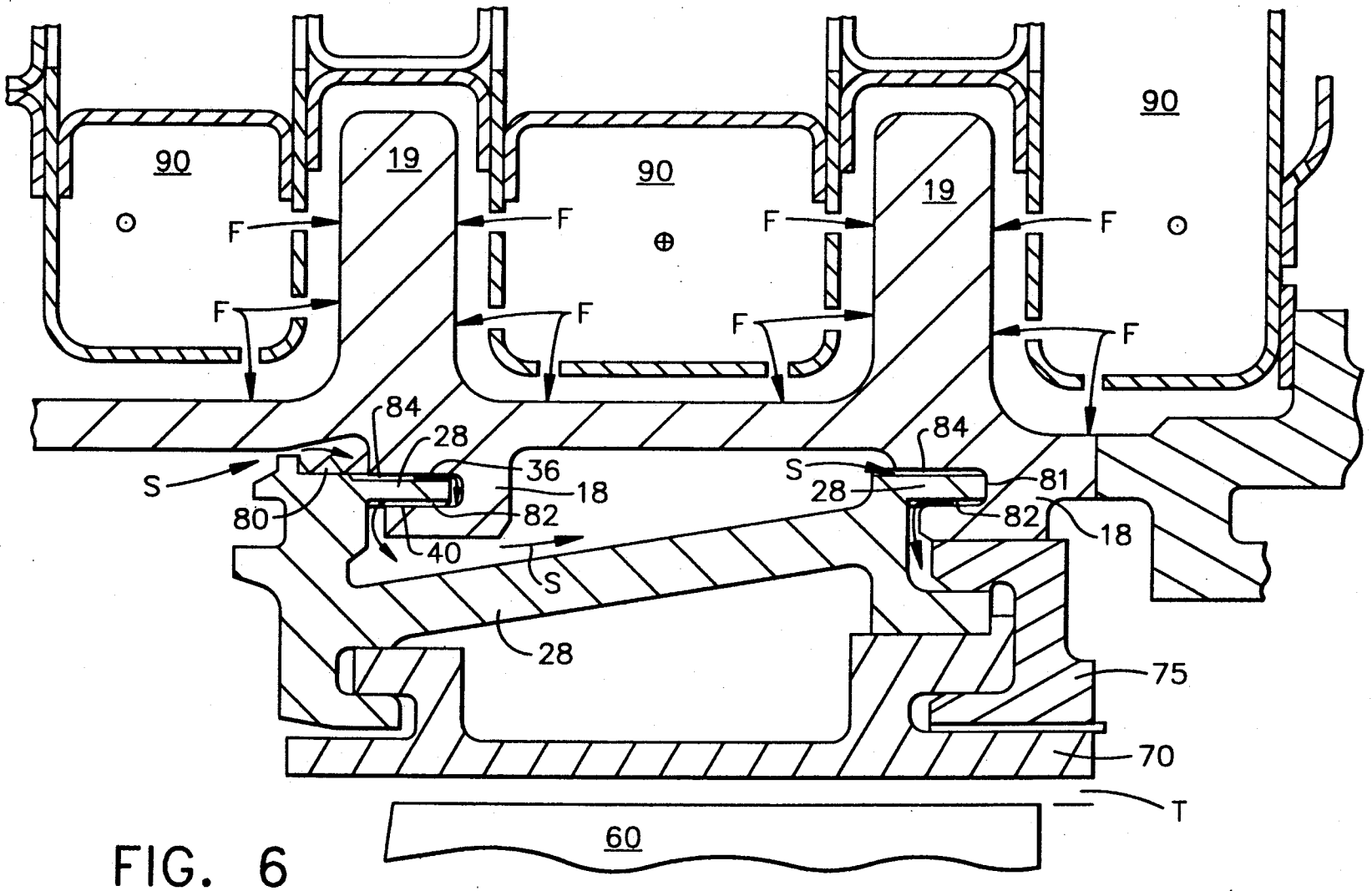
FIG. 6 is an enlarge illustration of the support hangar interface showing the flow control passages.

Referring now to FIGS. 5 & 6, a shroud hangar 28 positioned in an interference fit relation within a support 18 such as an engine case is shown. The support 18 has a first radius and a first width. The a flexible hangar 28 has a second radius and a second width and further has a first end and a second end wherein second radius is greater than said first radius to achieve an interference fit between the hangar 28 and the support 18. In installation the hangar 28 is elastically flexed to fit within the support 18 and achieves an spring force interference fit with said support 18 when installed. The hangar is flexed about an axis parallel with the center line.

A particular and unexpected advantage of this interference fit hangar-support 18 structure is that the clearance T between an rotating engine structure which can include a blade 60 and a stationary engine structure, which can include a shroud 70 supported from a hangar 28 and held in place by a U-clip 75, can be precisely regulated or controlled with less cooling air. An air flow control seal means 80, such as a W seal, is located between the hangar 28 and the support 18 and sets the volume rate of flow of the shroud cooing air S flowing between the hangar 28 and the support 18. The abutting relation between the case support 18 and the hangar 28 is also considered to be an auxiliary seal means 81. In a preferred embodiment the hangar 28 achieves a three point contact interference fit within the support 18 as is shown in FIG. 4. As is also illustrated in FIG. 4, the hangar 28 can include a plurality of air flow velocity control passages 82 and 84 to exactly set the heat transfer coeficients of the hangar 28 and the support 18. In a preferred embodiment the hangar 28 can include an upper air flow velocity control passage 84 and one or more lower air flow velocity control passages 82. The illustrated embodiment shows an upper air flow velocity control passage 84 positioned between two upper contact point 32 and 36 and two lower air flow velocity control passages positioned on either side of a lower contact point 40. The cross sectional area of the velocity control passages are selected to control the velocity and heat transfer coeficient of the air to match the thermal expansion rate of the support 18 to the theraml expansion rate of another engine part such as the turbine rotor tip 60.

One particular advantage of this structure is that it allows for more precise control of the thermal relationship between a stationary engine structure such as a shroud 70 and a rotating engine structure such as a rotor tip 60 to maintain clearance at a desired level to improve engine performance. It is further recognized that by controlling the thermal expansion of the shroud 70 and the support 18 there exists a reduced need for additional cooling from case cooling air F flowing from case cooling air manifolds 90 that impinges case cooling air F on case 18 and case rings 19. A clearance control manifold adjacent the support 18 would otherwise require more case cooling air F to maintain the desired clearance between the support 18 and the other engine part such as the rotor tip 60.

During installation, the hanger 28 is driven into the support member 18, creating a spring effect in the hanger 28. The spring effect is created by the flex, or deflection, in the end sections 30 and 34 of the hanger 28 to conform the end sections 30 and 34 to the first width X1 of the support member 18. The post-installation view shown in FIG. 4 illustrates a first clearance indentation 42 between the hanger 28 on either side of the third projection 40 and the support member 18 at the inside radius area, and a second clearance indentation 44 between the hanger 28, in between the projections 32 and 36, and the support member 18 at the outside radius area. Since the hanger 28 is preferably made of a material having elastic limits, and the spring effect is within the elastic limits of the hanger 28 material, the mechanical integrity and the form, fit, and function of the hanger 28 is not compromised.

The present invention provides for a method of achieving an interference fit. The interference fit is accomplished by machining and casting features into the hanger which create a spring effect when the hanger is assembled into the support member. The machining and casting features may include offset radial cut features on the hanger 10 relative to the support 18, or offset projection features on the hanger 28 which are concentric with the support 18. In either embodiment, the stress introduced in the hanger is within the material capabilities. Since the deflection of the hanger does not exceed the yield capabilities of the hanger material, allowing the hanger to maintain its elastic properties, the hanger can be removed and reinserted, rather than replaced or reworked.

It is seen from the foregoing, that the objectives of the present invention are effectively attained, and, since certain changes may be made in the construction set forth, it is intended that matters of detail be taken as illustrative and not in a limiting sense.

Having described the invention, what is claimed as new and desired to secure by Letters Patent is:

1. A method for accomplishing an interference fit comprising the steps of:

providing a support having a first radius and having a first width;

providing a hanger having a second radius and having a second width, and further having a first end and a second end;

offsetting said second radius of said hanger and said first radius of said support, such that said second radius is greater than said first radius;

driving said hanger into said support; and creating a spring in said hanger by flexing said first end and said second end of said hanger to conform to said first width of said support, and providing first and second clearance indentations at said first and second ends, and a third clearance indentation between said hanger and said support.

2. A method for accomplishing an interference fit as claimed in claim 1 wherein said first width is greater than said second width.

3. A method for accomplishing an interference fit as claimed in claim 1 wherein said hanger is comprised of a material having elastic limits.

4. A method for accomplishing an interference fit as claimed in claim 3 wherein said spring is within said elastic limits of said hanger material.

5. A method for accomplishing an interference fit comprising the steps of:

providing a support having a first radius and having a first width;

providing a hanger having a first end section having a first projection, a second end section having a second projection, and a middle section having a third projection, said first end section and said second end section having a second width at said first and second projections, and said middle section having a second radius and a third width at said third projection;

offsetting said first and second projections with said third projection, such that said first and second projections extend radially outwardly from one side of said hanger and said third projection extends radially inwardly in an opposite direction from an opposing side of said hanger;

driving said hanger into said support; and creating a spring in said hanger by flexing said first end section and said second end section of said hanger to conform to said first width of said support, and providing a first clearance indentation on either side of said third projection and a second clearance indentation between said first and second projections.

6. A method for accomplishing an interference fit as claimed in claim 5 wherein said first width is greater than said second width.

7. A method for accomplishing an interference fit as claimed in claim 5 wherein said first width is greater than said third width.

8. A method for accomplishing an interference fit as claimed in claim 5 wherein said first width is equivalent to a total width of said hanger measured from said first and second projections and including said third projection.

9. A method for accomplishing an interference fit as claimed in claim 5 wherein said first width is less than a total width of said hanger measured from said first and second projections and including said third projection.

10. A method for accomplishing an interference fit as claimed in claim 5 wherein said hanger is comprised of a material having elastic limits.

11. A method for accomplishing an interference fit as claimed in claim 10 wherein said spring is within said elastic limits of said hanger material.

12. An interference fit hanger comprising:

support having a first radius and having a first width;

a flexible hanger having a second radius and having a second width, and further having a first end and a second end wherein second radius is greater than said first radius and wherein said hanger is elastically flexed to fit within said support and achieves an spring force interference fit with said support when installed; and an air flow control seal means located between said hangar and said support.

13. The apparatus of claim 12 wherein said hangar achieves a three point contact interference fit with said support 14. The apparatus of claim 12 wherein said hangar includes air flow velocity control passages to exactly set the heat transfer coeficients.

15. The apparatus of claim 14 wherein said hangar includes an upper air flow velocity control passages.

16. The apparatus of claim 14 wherein said hangar includes a lower air flow velocity control passages.

17. The apparatus of claim 14 wherein said hangar includes an upper air flow velocity control passages and a lower air flow velocity control passages.

18. The apparatus of claim 14 wherein said hangar includes an upper air flow velocity control passages and two lower air flow velocity control passages positioned on either side of the lower contact point.

19. The apparatus of claim 14 wherein the cross sectional area of the velocity control passages are selected to control the velocity and heat transfer coeficient of an internal air flow to match the thermal expansion rate of the support to the theraml expansion rate of another engine part.

20. The apparatus of claim 19 further including a clearance control manifold adjacent said support for impinging air on the support to extract heat and establish a predetermined clearance between said support and said other engine part.

* * * * *